United States Patent [19]

Piolata

[11] Patent Number: 4,836,818

[45] Date of Patent: Jun. 6, 1989

[54] SPINNER TOY

[76] Inventor: Thomas P. Piolata, 1917 Stockwell Dr., Cols, Ohio 43220

[21] Appl. No.: 93,048

[22] Filed: Sep. 4, 1987

[51] Int. Cl.[4] ..... A63A 1/00

[52] U.S. Cl. ..... 446/236; 446/489

[58] Field of Search ..... 446/236, 227, 489, 170, 446/266, 132, 138, 137

[56] References Cited

U.S. PATENT DOCUMENTS

| | | | |
|---|---|---|---|
| 2,520,572 | 8/1950 | Slater | 446/236 |
| 2,785,503 | 3/1957 | Schaefer | 446/227 |
| 2,817,184 | 12/1957 | Inouye | 446/489 |
| 3,190,032 | 6/1965 | Green et al. . | |
| 3,425,698 | 2/1969 | Steiert et al. . | |
| 3,509,659 | 5/1970 | Kau . | |

FOREIGN PATENT DOCUMENTS

| | | |
|---|---|---|
| 17661 | of 1893 | United Kingdom . |
| 1044 | 5/1986 | United Kingdom . |

*Primary Examiner*—Robert A. Hafer
*Assistant Examiner*—Samuel Rimell
*Attorney, Agent, or Firm*—Harness, Dickey & Pierce

[57] ABSTRACT

A spinner toy includes a large circular device upon which there are a plurality of five smaller ciruclar devices, each carrying a plastic sleeve on its outer periphery. When the smaller ciruclar devices are spun by hand and the larger circular device is rotated, these smaller circular devices will spin for a long period of time and will travel upward on the large circular device, while at the same time spinning and fluttering rapidly. The device provides amusement and entertainment to the user.

3 Claims, 1 Drawing Sheet

SPINNER TOY

BACKGROUND OF THE INVENTION

1. Field of Invention

The invention relates generally to an amusement device.

2. Prior Art

Applicant is unaware of any patented devices which are similar to the Spinner Toy.

SUMMARY OF THE INVENTION

It is an object of the invention to provide an amusement device for providing entertainment to its user.

An amusement device includes a substantially circular closed main ring member and a plurality of substantially circular ring elements each having a central aperture surrounding the main ring member for rotation of the ring elements thereabout, each ring element including a plastic trim element surrounding its outer periphery, the plastic trim element providing for rounded edges enabling the facile spinning of the ring elements by hand. The ring elements are configured such that, upon initial spinning of the ring elements by hand-imparted tangential force upon the plastic trim elements, ring element spinning may be maintained by movement of the closed ring main member through the apertures of the ring elements.

BRIEF DESCRIPTION OF THE DRAWINGS

These and other objects and features of the invention will become apparent from a detailed description taken in conjunction with the drawings, in which.

DETAILED DESCRIPTION

Figure 1:
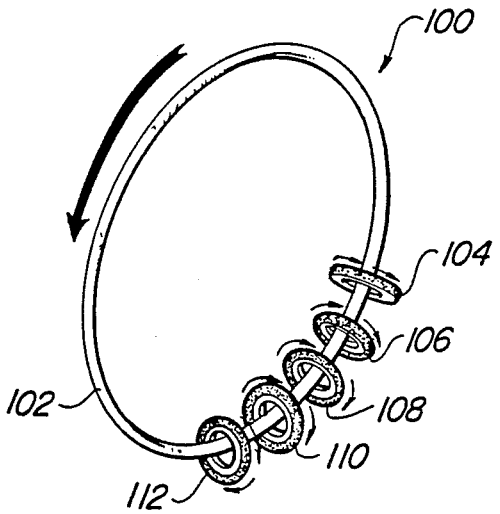
FIG. 1 is a perspective view of an amusement device arranged in accordance with the principles of the invention.
Figure 4:
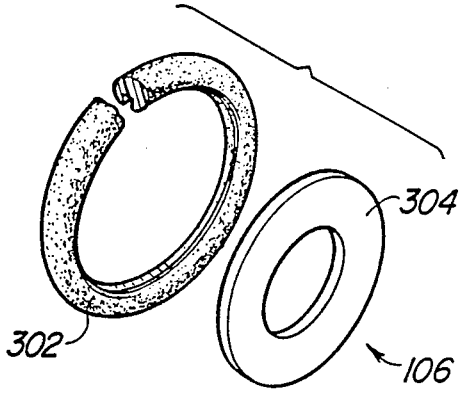
FIG. 4 is an exploded perspective view of one of the spinning ring elements mounted to the device of FIG. 1 of FIG. 2 along with its plastic trim element.
Figure 3:
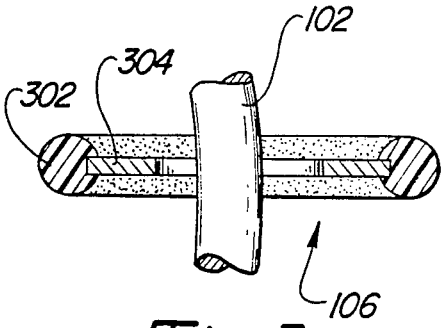
FIG. 3 is a cross sectional view taken along line 3—3 through one of the spinning ring elements of FIG. 2.
Figure 2:
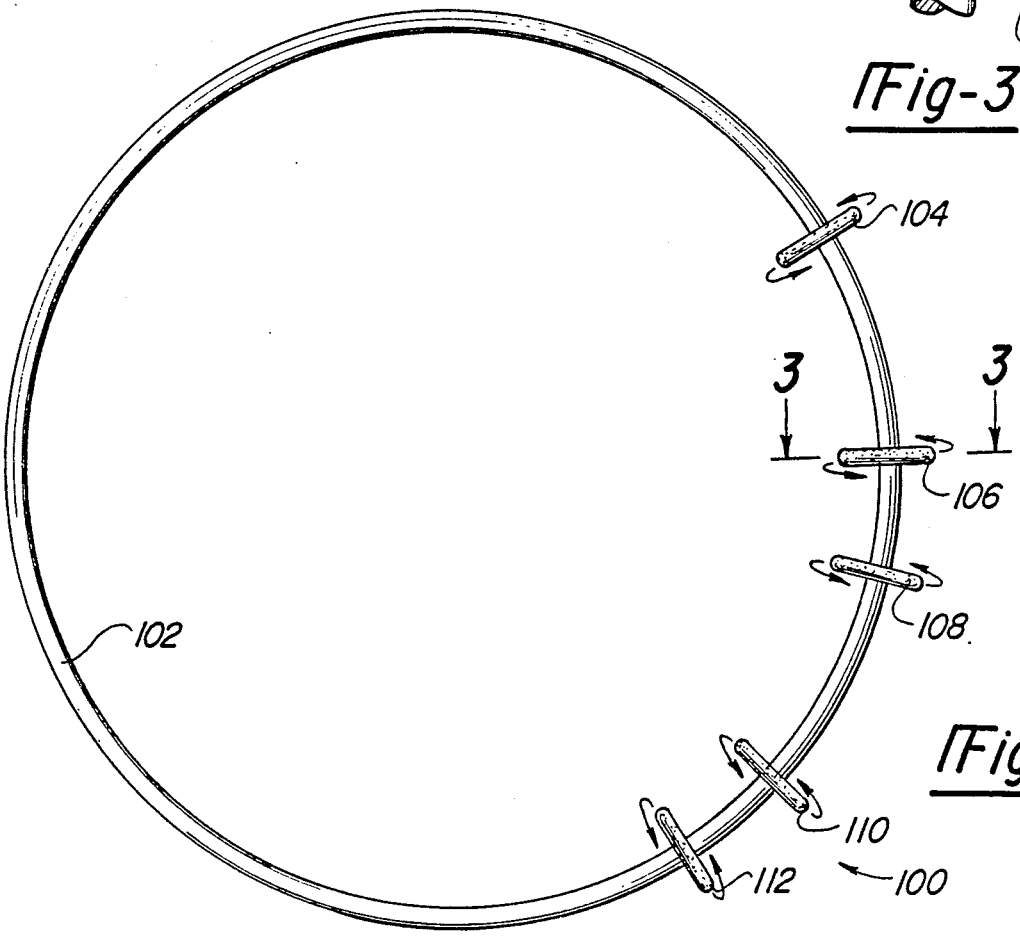
FIG. 2 is a front plan view of the device of FIG. 1.

The large circular device 100 consists of a 4 Ga. American Steel wire ring 102 with a butt weld ground smooth and is shown in FIG. 1. The diameter of the circular device is approximately 11 7/16". The large circular device itself can be made of different types of durable metal, fluted, smooth or chrome plated, to cause its 11 7/16" diameter. The steel wire ring must be 2.9946' long. The smaller circular devices 106, 108, 110 and 112 consist of 1"×16— Ga. U.S.S. Steel washers, of which there are five. See FIGS. 1 and 2. These washers are encased in a plastic trim ring shown at 302 which provides for rounded edges on the washers and allows the washers to be spun by hand. See FIGS. 3 and 4. These smaller circular devices are placed upon the rod before it is manufactured into its finished circular form.

The Spinner Toy 100 is operated when the smaller circular devices 106, 108, 110 and 112 are propelled with the operator's hand, causing them to spin rapidly. The operator then rotates the larger circle 102 rapidly, causing the smaller circles to slowly move toward the top of the larger circle. As the larger circle 102 is rotated, the smaller circles 106, 108, 110 and 112 spin and flutter rapidly. The rotating motion will allow the smaller circles to spin and flutter for long periods of time.

While the above description contains many details, these should not be construed as limitations on the scope of the invention, but rather as an exempliciation of one preferred embodiment thereof. Many other variations are possible.

I claim:

1. An amusement device comprising:

a substantially circular closed main ring member; and a plurality of substantially circular ring elements each having a central aperture surrounding the main ring member for rotation of the ring elements thereabout, each ring element further comprising a diametrically outermost substantially cylindrical outer peripheral surface, two substantially planar lateral surfaces extending inwardly from the outer peripheral surface towards the aperture, and a substantially cylindrical inner peripheral surface defining a boundary of the aperture, each ring element including a plastic trim element surrounding the outer peripheral surface and a portion of each lateral surface and not covering the inner peripheral surface, the plastic trim element providing for rounded edges enabling facile spinning of the ring elements by hand;

the ring elements being configured such that, upon initial spinning of the ring elements by hand-imparted force upon the plastic trim elements, ring element spinning may be maintained by movement of the closed ring main member through the central apertures of the ring elements.

2. The amusement device of claim 1 wherein at least five ring elements are positioned for rotation about the main ring member.

3. The amusement device of claim 1 wherein the plastic trim element presents a generally arcuate lateral surface above the portion of each lateral surface of a ring element which the plastic trim element surrounds, thereby preventing contact with adjacent ring elements except at the arcuate lateral surfaces of the plastic trim elements associated with the ring elements.

* * * * *